US007809253B2

(12) United States Patent
Mudry et al.

(10) Patent No.: US 7,809,253 B2
(45) Date of Patent: Oct. 5, 2010

(54) COMPACT AIR DRYING SYSTEM

(75) Inventors: Roman J. Mudry, Wasco, IL (US); Mark R. Atkins, Wasco, IL (US)

(73) Assignee: FlexAir, Inc., Green Bay, WI (US)

( * ) Notice: Subject to any disclaimer, the term of this patent is extended or adjusted under 35 U.S.C. 154(b) by 325 days.

(21) Appl. No.: 11/473,094

(22) Filed: Jun. 22, 2006

(65) Prior Publication Data

US 2006/0239669 A1 Oct. 26, 2006

Related U.S. Application Data

(63) Continuation-in-part of application No. 09/939,144, filed on Aug. 27, 2001, now Pat. No. 7,187,856.

(51) Int. Cl.
*F24H 1/10* (2006.01)

(52) U.S. Cl. ..... 392/360; 392/484; 392/379; 34/226

(58) Field of Classification Search ..... None
See application file for complete search history.

(56) References Cited

U.S. PATENT DOCUMENTS

| | | | | |
|---|---|---|---|---|
| 1,479,819 | A | | 1/1924 | Kluever |
| 1,724,644 | A | | 8/1929 | De Long |
| 1,768,498 | A | | 6/1930 | Willsea |
| 1,955,055 | A | | 4/1934 | Date |
| 2,041,238 | A | | 5/1936 | Fickes |
| 2,298,803 | A | | 10/1942 | Morris |
| 2,420,739 | A | | 5/1947 | Dorsch |
| 2,578,633 | A | | 12/1951 | Mauffre |
| 2,627,667 | A | | 2/1953 | Gillis |
| 2,731,732 | A | | 1/1956 | Harris, Jr. et al. |
| 2,831,951 | A | | 4/1958 | Desloge |
| 3,970,822 | A | | 7/1976 | Wrob |
| 4,207,457 | A | | 6/1980 | Haglund et al. |
| 4,233,901 | A | | 11/1980 | Mallinson |
| 4,340,893 | A | | 7/1982 | Ort |
| 4,386,650 | A | | 6/1983 | Moen |
| 4,504,220 | A | | 3/1985 | Sunakawa et al. |
| 4,535,222 | A | | 8/1985 | Moen |
| 4,567,673 | A | | 2/1986 | Bohnensieker |
| 4,756,091 | A | * | 7/1988 | Van Denend ..... 34/266 |
| 5,086,700 | A | * | 2/1992 | Van Den Berg ..... 101/424.1 |
| 5,113,931 | A | | 5/1992 | Oswalt et al. |
| 5,212,763 | A | | 5/1993 | Arold et al. |
| 5,303,325 | A | | 4/1994 | Pasternak et al. |
| 5,370,047 | A | | 12/1994 | Compton |
| 5,502,788 | A | * | 3/1996 | Platsch ..... 392/424 |
| 5,765,294 | A | | 6/1998 | Puschnerat |
| RE36,083 | E | | 2/1999 | Spiegel et al. |
| 5,881,647 | A | | 3/1999 | Siler et al. |
| 5,937,535 | A | * | 8/1999 | Hoffman et al. ..... 34/78 |

(Continued)

*Primary Examiner*—Thor S Campbell
(74) *Attorney, Agent, or Firm*—Erickson Law Group, PC

(57) ABSTRACT

A fully integrated drying or heating system utilizes forced air and electrical heaters. A solid cartridge heater is enclosed within a heater cavity of a block. The block includes a separate air cavity in heat transfer communication with the heater through a solid portion of the block. The blocks are shaped and configured to be used in banks of plural blocks, with the operating controls and all the components of the air distribution system and air heating system fully integrated into a modular package.

13 Claims, 13 Drawing Sheets

U.S. PATENT DOCUMENTS 5,937,761 A * 8/1999 Buschmann et al. ..... 101/424.1
6,176,184 B1 * 1/2001 Mudry ..... 101/424.1
6,601,318 B1 * 8/2003 Platsch ..... 34/629

* cited by examiner

COMPACT AIR DRYING SYSTEM

This application is a continuation-in-part of U.S. Ser. No. 09/939,144 filed Aug. 27, 2001.

BACKGROUND OF THE INVENTION

This invention relates to evaporative drying systems, hereinafter called dryers, more particularly to dryers that are used to dry-solvent based or water-based inks, paints or coatings.

Traditional dryers dry by projecting heated air and/or radiating heat energy. The most common form of a projected air dryer delivers lightly pressurized preheated air into a distribution plenum, which is then dispersed through a series of slots or circular orifices to the medium being dried. These types of dryers typically rely on large volumes of air to adequately dry, thus consuming substantial amounts of energy and requiring extensive air handling equipment.

In some of the more recent forced hot air dryers, compressed air is preheated prior to entering the distribution plenum(s). The preheating is typically accomplished by the use of a separate heat plant device such as the common triple pass or inline air heater. Using a heat plant that is separated from the air distribution system introduces inefficiencies of operation; additional equipment and manufacturing costs; and additional equipment. The added equipment can also make the dryer prohibitively large in size for some applications that have limited available space.

Current dryer systems have their operating controls located remotely from the distribution plenum(s), which increases the complexity of the controls system and the associated costs for the manufacturing and installation of the entire system.

SUMMARY OF THE INVENTION

The invention provides a forced hot air dryer for the printing, painting and coating industries that fully integrate the air handling equipment, heat plant, air flow control and air temperature control into a single compact package. The preferred embodiment utilizes a solid cartridge heater within a specially designed air distribution system to raise the temperature of the forced air just before it discharges. The invention greatly simplifies the complexity, reduces space requirements, and maximizes the energy efficiencies over current drying systems.

The invention can be used to dry printing, textiles, paint, nail polish, etc. The invention can provide dryer modules that can be "ganged" or clustered, or used separately. The dryer module or modules can be used in shops, factories, or salons.

Numerous other advantages and features of the present invention will be become readily apparent from the following detailed description of the invention and the embodiments thereof, from the claims and from the accompanying drawings.

BRIEF DESCRIPTION OF THE DRAWINGS

The invention will be explained in conjunction with illustrative embodiments shown in the accompanying drawings, in which.

DESCRIPTION OF THE PREFERRED EMBODIMENTS

Figure 1:
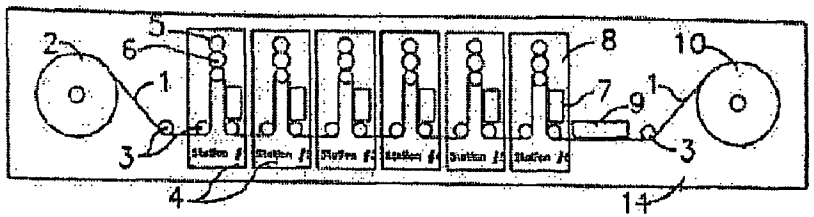
FIG. 1 is a schematic illustration of a narrow web inline printing press with multiple color stations.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Printing, coating, and painting lines have various configurations and methods of operation. Configurations vary in the number of printing decks, method of conveying the product, line speeds, etc., which will all depend on the type of product, process, and application. Products can be conveyed in several different ways such as in the form of a continuous web, sheet, or simply moving the product through via a conveyor.

More particularly, the flexographic press, illustrated in FIG. 1 is a conventional and well-known type of narrow web printing and/or coating press, hereinafter called narrow web press 11. The narrow web press 11 typically prints and/or applies coating on a continuous web 1, hereinafter called web, whereupon the freshly applied inks or coating need to be dried. The web 1 enters the narrow web press from the unwind station 2 and then travels through a series of idler rollers 3 in a serpentine path while passing through multiple print stations 4.

Figure 2:
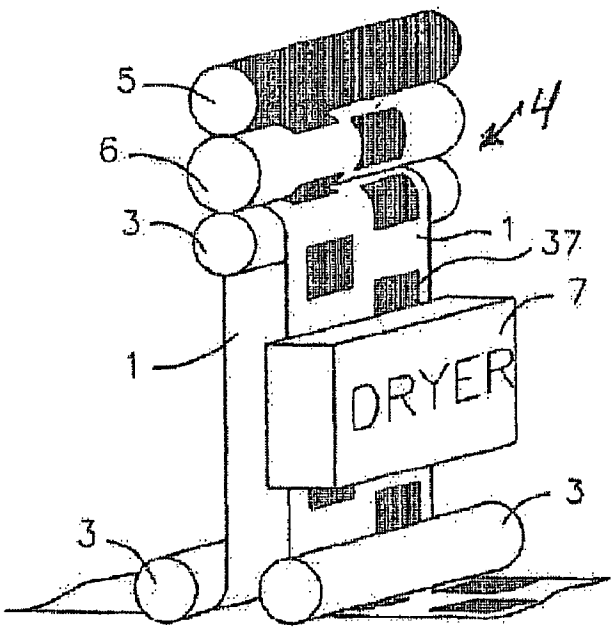
FIG. 2 is a schematic illustration detailing a single color station of the narrow web in-line printing press of FIG. 1.

FIG. 2 details an individual printing station of FIG. 1. A print station 4 consists of a transfer roll 5 and plate roll 6 that apply a printed image 37 or coating onto the web as it passes through the print station 4. After being applied to the web, the printed image 37 or coating moves past the transfer roll and plate roll area, and subsequently enters a drying zone 7 where it will be partially or completely dried before entering the next printing station.

As the printed or coated web exits the last printing station 8, depending on the product, process, and application, a final drying stage 9 may be required. The final drying stage 9 may be comprised of a single or multiple dryers. The final drying stage will evaporate the residual traces of ink solvents from the ink, and/or cure the already substantially dried inks prior to being rewound in the narrow web press rewinder 10.

The practice of configuring the combination of the web, unwind, print stations, dryers, and rewind is well known. The particular configuration of these fundamental elements of a printing press can vary greatly between printing technologies and process applications.

The exemplary embodiments of the invention create means of efficiently transferring heat energy from a solid cartridge heater to the air as the air passes through the air distribution system. The exemplary embodiments of the invention substantially equalize the temperature of the heated air that is projected out of the dryer, across the dryer width.

The solid cartridge heater is a commercially available device that is typically used to heat solid metal structures for plastic or metal manufacturing processes, and to heat liquids in tanks or pipes. The heating element is an electrical resistance heater that is ultimately powered by a voltage source. Various size solid cartridge heaters can be used that may vary in diameter, length, power level and mounting depending on the process and application. The preferred solid cartridge heater is of cylindrical geometry of approximately ½ inch cylindrical diameter with the cylindrical length of the solid cartridge heater approximately equal to the dryer width. The solid cartridge heater is well described in U.S. Pat. No. 3,970,822, herein incorporated by reference.

To simply pass air over a solid cartridge heater that is housed within a simple shell plenum such as a common cylindrical or square tube may result in non-optimal operating conditions, including inefficient and uneven transfer of heat energy to the air. The inefficiencies originate from the limited surface area of the solid cartridge heater that is exposed to the passing air as well as unrestricted airflow patterns within the simple shell. The inefficient and uneven heat transfer results in localized hot spots within the solid cartridge heater that can severely reduce the, operable life of the solid cartridge heater and can produce greatly varying forced air temperatures across the width of the dryer.

Figure 3:
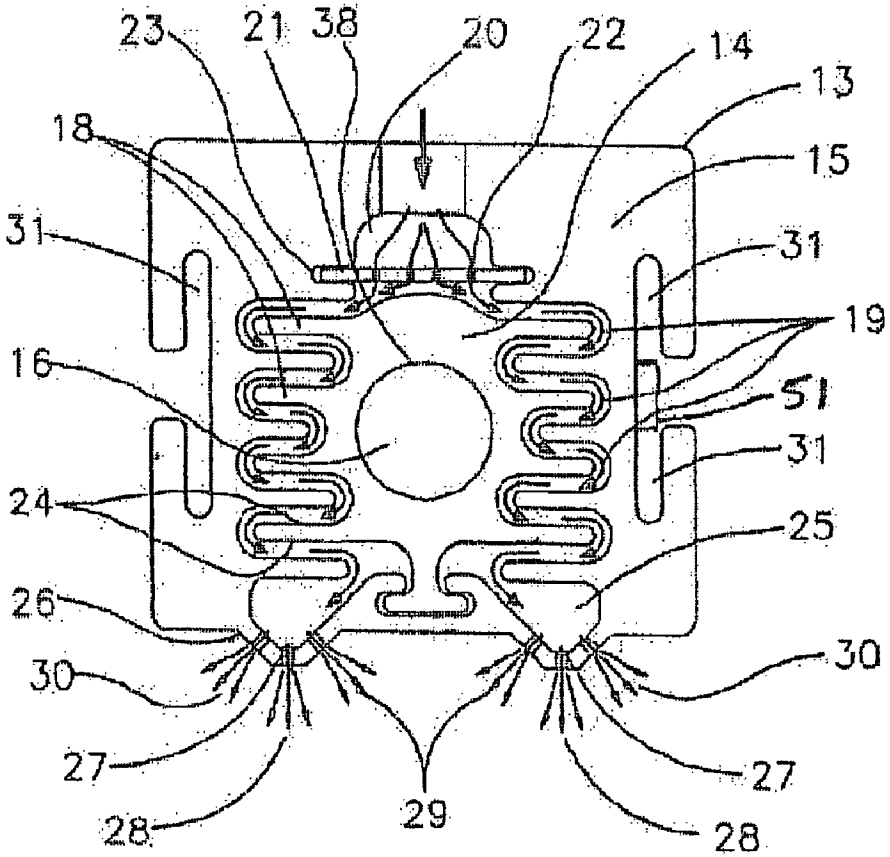
FIG. 3 is an end view of the air distribution system.

The exemplary embodiments of this invention incorporate a specially designed air heater module or air distribution system 13 that is fundamentally comprised of two separate metallic extrusions including the cartridge heat exchanger 14 and air distribution plenum 15 as shown in FIG. 3.

Figure 4:
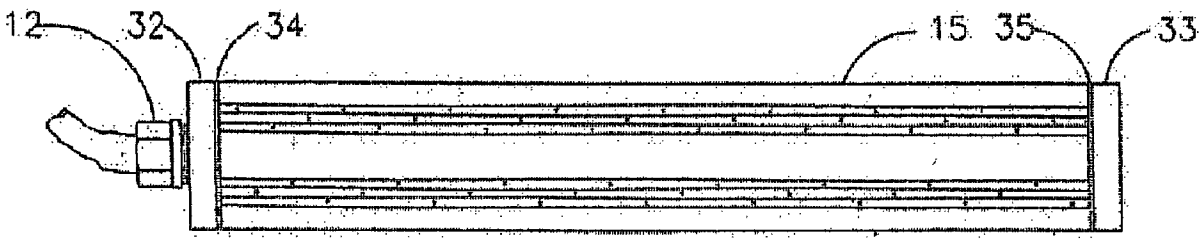
FIG. 4 is a side view of the air distribution system and solid cartridge heater.
Figure 5:
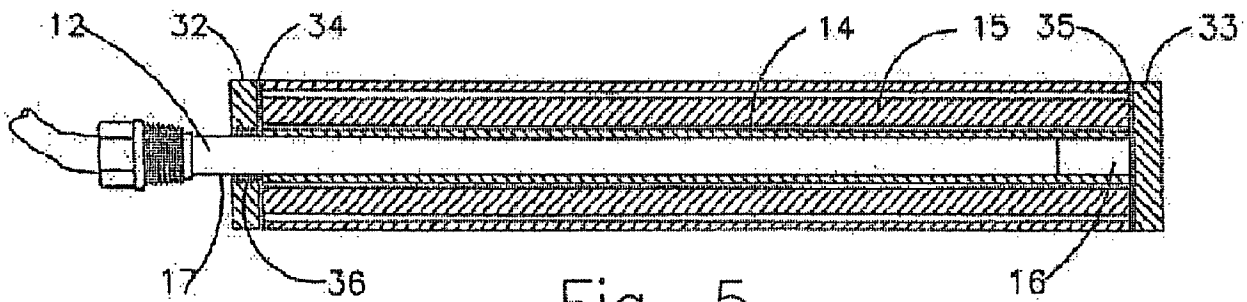
FIG. 5 is a cross-sectional view of FIG. 4 with the solid cartridge heater partially removed.

According to one preferred embodiment, the cartridge heat exchanger 14 is designed with a cylindrical cavity 16 to accept the solid cartridge heater 12 (See FIGS. 4 and 5). The cylindrical diameter of the cylindrical cavity 16 is carefully controlled to minimize the clearance between the outside surface of the solid cartridge heater 17 (See FIG. 5) and the internal surface of the cylindrical cavity 38 in the cartridge heat exchanger 14 to provide better heat transfer and power density of the solid cartridge heater 12.

The cartridge heat exchanger 14 has multiple heat fins 18 that extend outwardly from the cylindrical cavity 16. The outer geometrical profile of the cartridge heat exchanger 14 compliments the internal geometry of the air distribution plenum 15 to create air passages 19. During operation, the solid cartridge heater 12 is energized by a voltage source. Heat that is generated by the solid cartridge heater is transferred into the cartridge heat exchanger 14 and will migrate outwardly into the heat fins 18. The heat energy is then transferred to the air moving along the heat fin surfaces 24 as the air moves through the air passages 19.

Pressurized air enters the air distribution system 13 through a port that leads into the inlet cavity 20 of the air distribution plenum. Located at the bottom of the inlet cavity 20, a baffle plate 21 is used to redistribute the air in order to provide a uniform and even air flow along the dryer width as the air exits the inlet cavity 20 through the baffle plate 21. The baffle plate 21 is fabricated with a pattern of baffle plate orifices 22 that may vary in diameter, spacing, and arrangement across the width and length of the baffle plate 21 to facilitate the desired even and uniform flow. The baffle plate is located and captured by the baffle plate recesses 23 that are incorporated into the inner geometry of the air distribution plenum 15.

Once the air passes through the baffle plate 21, the air moves along the heat fin surfaces 24 as shown in FIG. 3. As the air passes over the surface of the heat fins 18, the air absorbs the heat energy from the heat fins 18 of the cartridge heat exchanger 14 through thermal convection. The circuitous air passages 19 increase the dwell time that the air is in contact with the heat fins 18 thus increasing the convective heat transfer efficiency.

Engineering thermodynamics holds that heat energy output, is directly proportional to the convective heat transfer coefficient, h, the surface area, A, and the temperature differential, $\Delta T$, where $Q=h*A*\Delta T$. By increasing the heat transfer surface area, the temperature differential between the heater and air can be lowered inversely while maintaining a substantially equivalent heat energy output to the air. The lowered temperature differential allows the solid cartridge heater to operate at lower temperatures, thereby increasing the expected life of the solid cartridge heater.

At the end of the circuitous air passages 19 the heated air enters one of two orifice chambers 25 located near the bottom of the air distribution plenum 15. The air distribution plenum walls 26 in the area of the orifice chambers 25 are fashioned to provide a simplified means of manufacturing a series of air release orifices 27 that connect the orifice chamber 25 with the outside of the air distribution system 13. The air release orifices 27 can be manufactured to project the air either directly away 28 from the air distribution system, canted towards the middle 29 of the air distribution system or outwardly from the middle 30 of the air distribution system. In the preferred embodiment shown in FIG. 3, the canted surfaces are constructed at 45 degrees to the central axis of the air distribution system 13.

The air release orifices 27 may vary in diameter, spacing, and arrangement across the width and length of the air distribution system 13, depending on the process or application. The air release orifices 27 are typically 1 millimeter in diameter or less.

Solid cartridge heaters are commercially available with variable power densities along the axial length of the solid cartridge heater as well described in U.S. Pat. No. 3,970,822. The variable power densities can be used to counteract hot or cold spots resulting from uneven flow patterns past the solid cartridge heater. The variable power densities can also be used to deliberately create heated and unheated regions along the length of the solid cartridge heater. This allows the dryer system to be very versatile in meeting certain process or application requirements where more or less drying capacity is required in specific intervals or in specific areas along the width of the dryer.

In the embodiment shown in FIG. 3, two isolated elongated thin recesses 31 are located towards the outside wall of the air distribution plenum 15 to function as thermal insulators between the air passages 19 and the outside of the air distribution plenum 15. By creating a barrier for heat transfer from the air passages 19 to the outside walls of the air distribution system, the elongated thin recesses 31 improve the overall efficiency of the invention and maintain a reduced external surface temperature of the air distribution system 13.

In the embodiment shown in FIGS. 4 and 5, the air distribution system 13 is manufactured with end plates 32 and 33, and gaskets 34 and 35 to effectively seal off the inlet cavity 20, air passages 19 and orifice chambers 25 from the outside of the air distribution system 13. One of the end plates, the heater bulkhead end plate 32 is manufactured with a threaded port 36 to fasten the solid cartridge heater 12, and to effectively prevent pressurized air from escaping at the juncture of the solid cartridge heater 12 and the heater bulkhead end plate 32. The threaded port 36 also provides a convenient means of assembling and/or replacing the solid cartridge heater 12.

By the means described above, the heat source for the dryer unit has been completely integrated within the air distribution system to result in a very compact package. In this embodiment, the end profile of the air distribution system 13 as shown in FIG. 3 is approximately 2" by 2".

The embodiment described herein is capable of operating the solid cartridge heater at high temperatures while simultaneously maintaining substantially lower external surface temperatures given that air is flowing adequately through the air distribution system. This is important where human interaction can cause bodily injury upon skin contact with the hot surfaces.

The process of evaporative drying of inks, coatings, and paints is not instantaneous. In many cases the maximum narrow web press line speed is limited by the drying capacity of the dryer system. In the prior art, it is standard dryer design practice to increase drying capacity by adding additional length to the dryer, thus increasing the residence time of the product being dried within the dryer.

The invention increases drying capacity by: the incremental addition of air distribution systems; redistributing a given number of air distribution systems over a greater dryer length; or a combination of both. It is to be understood that the addition of an air distribution system will also, but not necessarily always, include the addition of an integrated solid cartridge heater.

Figure 6:
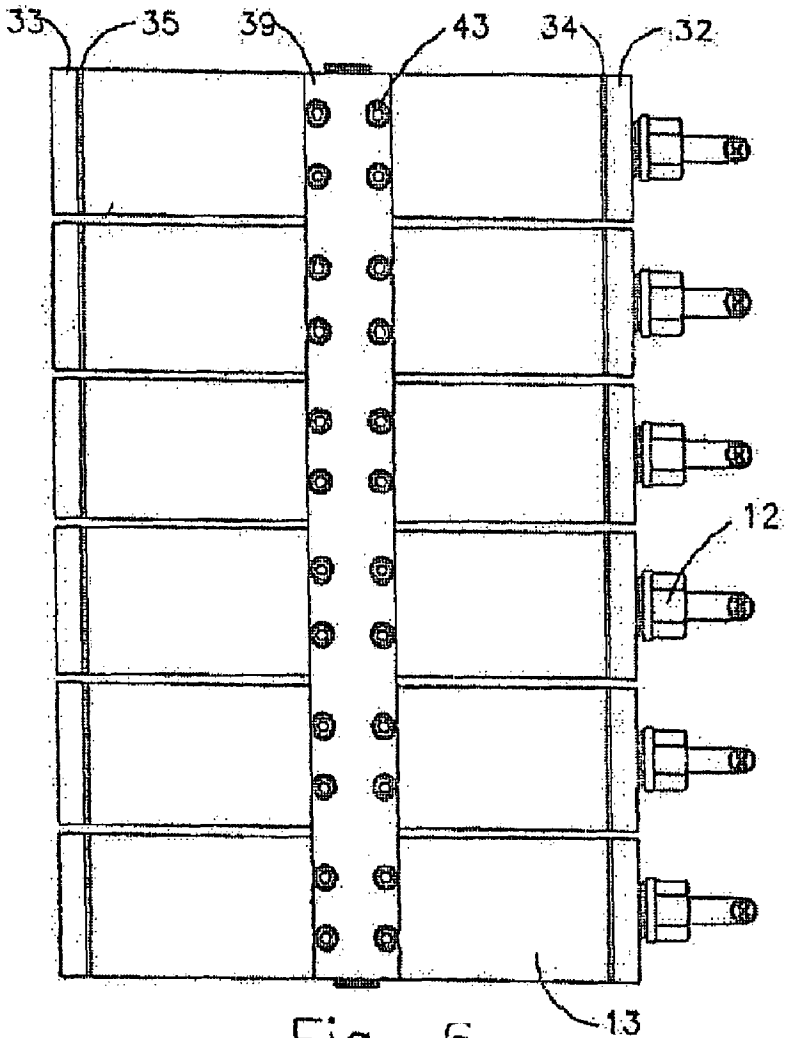
FIG. 6 is a side view of the manifold connected to multiple air distribution systems.
Figure 7:
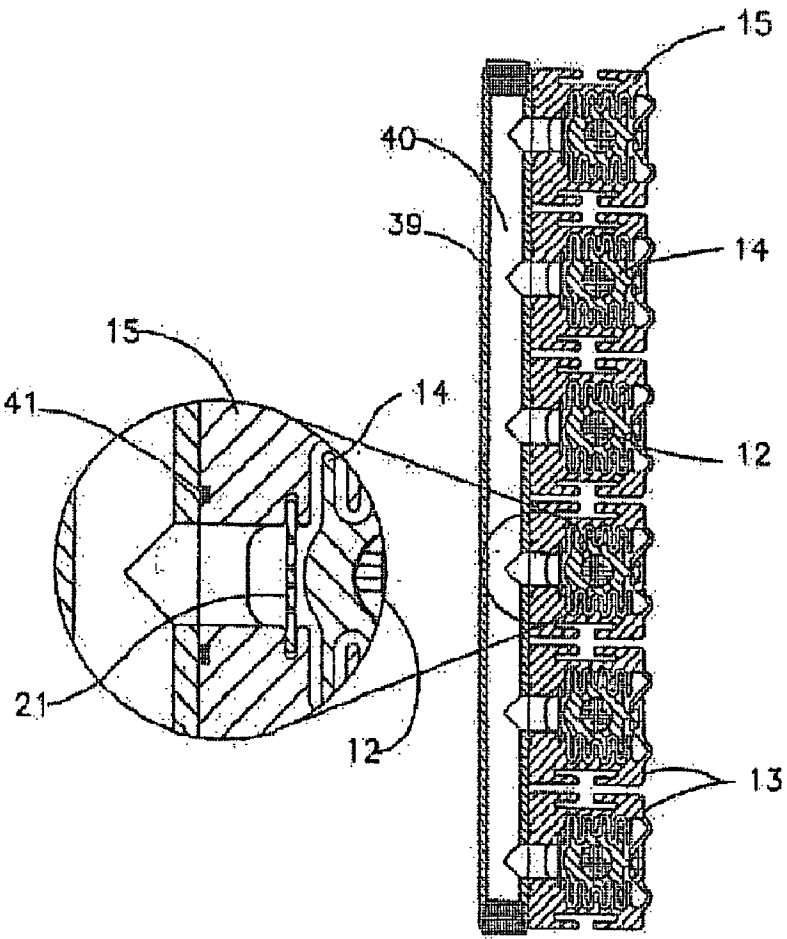
FIG. 7 is a cross-sectional front view of FIG. 6.

FIGS. 6 and 7 illustrate the means by which the invention incorporates a manifold 39 to accommodate multiple air distribution systems 13. The manifold 39 used to couple the air distribution systems has a central cavity 40 in the major axis of the manifold that is sized sufficiently to provide adequate air flow to all coupled air distribution systems 13. The coupling of the air distribution system to the manifold can be achieved through a variety of means including threading, sealant, liquid gasket, crushed-gasket sealing, etc. An exemplary arrangement is an o-ring face seal 41 held at the joining surfaces of the manifold 39 and the air distribution system(s) 13. A series of fasteners 43 are used to preload the o-ring 41 and to prevent the air distribution system 13 from moving relative to the manifold 39.

The control of the preferred embodiment of the invention involves control of air flow and control of electrical power to the solid cartridge heater. The preferred embodiment of the invention provides a means for operators of the invention to vary both the temperature of the air and flow of the air to dry the product. This variability is necessary because products that can be processed on the narrow web press have broad ranges of thermal yield characteristics, and excessive temperature and airflow conditions can detrimentally affected fragile product structures.

An exemplary embodiment of the invention utilizes a simple and inexpensive control system for the dryer system.

The volume of air moving through an air conveying medium such as tubing or piping, hereinafter referred to as pipe, is dependent on the geometry of the pipe and the inlet pressure of air moving into the pipe. Variations in inlet pressure, pipe diameter, or pipe length can have a significant affect on the volume of air flowing through the pipe. It is difficult to reliably control the air flow through a pipe system by controlling the pipe system's inlet pressure if the characteristic of the downstream pipe system are unknown or if the pipe geometry can change arbitrarily. This is the inherent difficulty of utilizing a centralized or remotely located flow control system to control flow in a widely distributed air distribution system. Such systems will typically rely on remote sensing of pressure and/or flow and therefore adjust the pipe system's inlet pressure accordingly. It is one advantage of the invention to overcome the undesirable effects noted above.

It is foreseen that multiple drying systems will be integrated into a narrow web press; therefore, it is an advantage of the invention that a repeatable control of air flow is possible by using a common air flow setting for each respective dryer system. According to the exemplary embodiment of the invention, by maintaining consistent pipe geometry in each dryer system, air flow through the air distribution system can be reasonably predicted and adequately controlled by controlling the inlet pressure into the dryer system.

Figure 8:
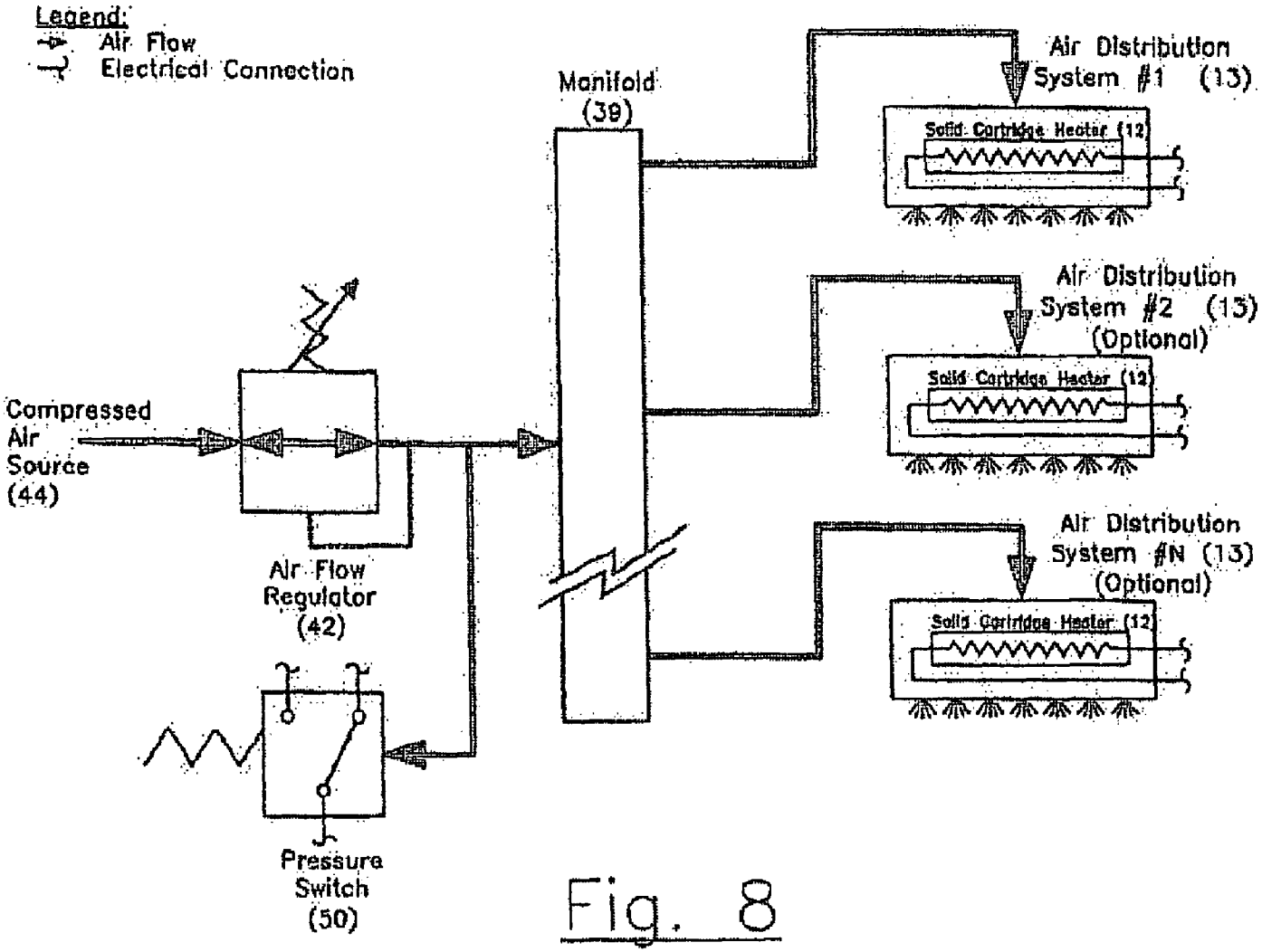
FIG. 8 is a schematic illustration of the air flow control system for the dryer.

As illustrated in FIG. 8, the air flow control system is achieved by the use of an air flow regulator 42 which is a relatively inexpensive, minimally complicated, and commercially available device. Pressurized air 44 is supplied to the air flow regulator 42 which controls the output pressure of the air flow discharging from the air flow regulator 42. The air flow regulator pressure is substantially equivalent to the inlet pressure of the pipe. The volume of air flowing out of the air flow regulator 42, and thus through the dryer system, can be modified by changing the settings of the air flow regulator 42.

The solid cartridge heater is an electrical device with an electrical resistance, R, that generates thermal power, P, from electrical current, I, by Ohm's Law ($P=I^2R$). Note the electrical current is also related to the electrical voltage, V, by Ohm's Law. ($I=V/R$) therefore ($P=V^2/R$). The electrical resistance of the solid cartridge heater is dependent on the operating temperature of the solid cartridge heater typically varying the electrical resistance of the solid cartridge heater by a margin of approximately 10%. The electrical resistance increases with the operating temperature of the solid cartridge heater. For the purpose of the following description, the electrical resistance of the solid cartridge heater will be treated as a constant value, R.

The amount of electrical power consumed by the solid cartridge heater is directly related to the thermal power delivered to the heated air flow that is discharging from the air distribution system. By controlling the electrical power and volume of air flow, the temperature of the air flow can be controlled.

Figure 9:
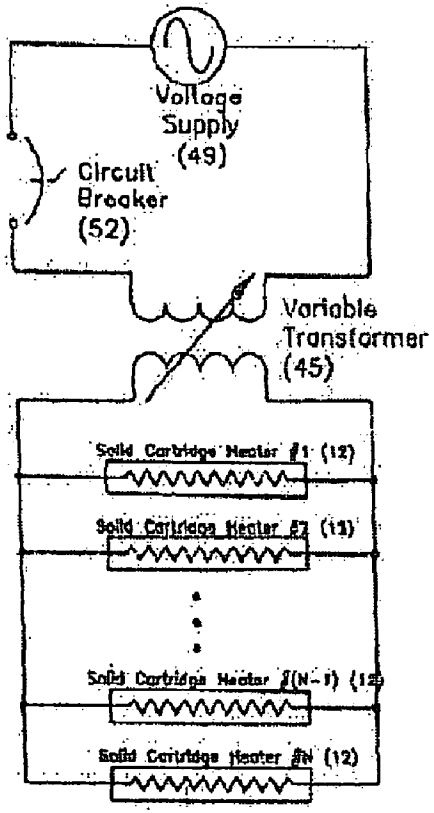
FIG. 9 is a schematic illustration of a variable transformer electrical control system for the dryer.

A relatively simple scheme for controlling the power to the solid cartridge heater is to control the voltage to the solid cartridge heater. FIG. 9 illustrates a voltage controller based on a mechanically adjustable variable transformer, hereinafter referred to as the variable transformer 45. The variable transformer 45 is a commercially available device.

The variable transformer 45 allows simple adjustment of the output coil of the variable transformer 45 thus effecting the voltage output ratio of the variable transformer 45. The variable transformer 45 is typically manually adjusted to supply a constant output voltage at the desired voltage amplitude. The output voltage from the variable transformer 45 serves as the supply voltage for the solid cartridge heater 12. In this fashion a constant supply voltage is applied to the solid cartridge heater 12. Also as shown in FIG. 9 multiple solid cartridge heaters 12 can be connected in parallel across the supply voltage.

Adjusting the output voltage to one-half of the maximum output voltage will produce one-fourth the power produced at the maximum output voltage as can be determined from Ohm's Law ($\frac{1}{4}*P_{max}=((\frac{1}{2})*V_{max})^2/R$). The variable transformer is an elegant means of adjusting the output power of the heater and the respective drying capacity of the dryer.

One advantage of using the variable transformer control system is the low cost and low complexity.

A further advantage of using the variable transformer control system is the ability to energize the solid cartridge heater (s) at a fraction of their rated power continuously, even without air flow through the air distribution system. This provides a convenient and more economical means of pre-heating the dryers by avoiding the consumption of pressurized air.

In using the variable transformer control system as the primary electrical control system, the variable transformer control system lacks a closed-loop temperature control. At a constant output voltage setting a change in the air flow volume will affect the air flow discharge temperature. Thus without an independent temperature sensor monitoring the dryer operating temperature, the operator of this dryer will not have an accurate measure of the effective drying temperature. Furthermore, even with a temperature sensor feedback, a mechanically adjusted variable transformer would be very complex to configure to automatically control to a desired dryer operating temperature.

In practical operation, depending on the product, process, and application, the air flow settings and the variable transformer settings can be determined through trial and error, and subsequently used as reference settings to reliably reproduce the same dryer conditions in the future on any of the variable transformer controlled dryers on the narrow web press.

The variable transformer control system provides an effective means for operating the dryer, however the preferred dryer system includes a means to control to a desired dryer operating temperature since an acceptable level of drying is more readily correlated to a dryer temperature.

Figure 10:
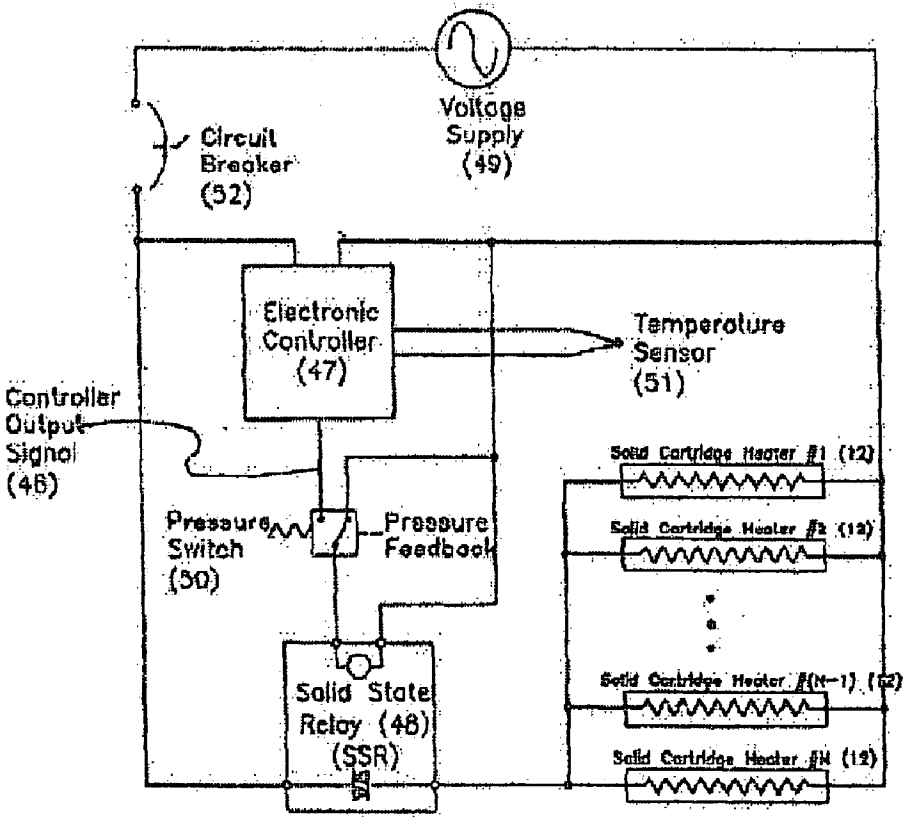
FIG. 10 is a schematic illustration of an electronic control system for the dryer.

The electrical control system illustrated in FIG. 10 uses an electronic controller 47 to modulate the supply voltage 49 to the solid cartridge heater(s) 12 between an energized and de-energized state. In this scheme, the supply voltage 49 to the solid cartridge heater(s) 12 is modulated at either the maximum supply voltage setting or none at all. The amount of thermal power delivered by the dryer system is related to the percentage of time the dryer is energized.

The electronic controller 47 is a commercially available device that can be obtained in a variety of configurations and with a variety of features. In this preferred embodiment the controller output signal 46 from the electronic controller is a low voltage, low power signal incapable of energizing the solid cartridge heater(s) 12 directly. However, this low voltage, low power controller output signal 46 can be used to activate a secondary device such as a mechanical relay or solid state relay to energize the supply voltage to the solid cartridge heater 12. In the embodiment shown in FIG. 10, a solid state relay 48 is used to energize the supply voltage 49 to the solid cartridge heater(s) 12 when the solid state relay 48 is commanded by the electronic controller 47 via the controller output signal 46.

The electronic controller 47 utilizes an external temperature measurement and compares it to a pre-set temperature as established by the operator of the narrow web press. The pre-set temperature settings depend on the product, process, and application. If the external temperature measurement is lower than the pre-set temperature, the electronic controller 47 commands the solid state relay 48 to energize the supply voltage 49 to the solid cartridge heater(s) 12. If the external temperature measurement is higher than the pre-set temperature, the electronic controller 47 commands the solid state relay 48 to de-energize the supply voltage 49 to the solid cartridge heater(s) 12.

A potential problem of this scheme is that the electronic controller continues to command an energized state of the supply voltage whenever the external temperature measurement is below the pre-set temperature. This condition can exist when the air flow to the dryer system is shut-off either intentionally or mistakenly. Since this control scheme will only supply the maximum supply voltage when energized, the above condition can place the solid cartridge heater(s) at a severe risk of failure from reaching excessive temperatures.

A solution to this problem is the integration of an electro-mechanical pressure switch or pressure transducer to monitor the pressure and thus flow of air through the air distribution system. The electro-mechanical pressure switches and pressure transducers are commercially available devices. In this preferred embodiment, an electro-mechanical pressure switch 50 monitors the air pressure of the air distribution system and allows the controller output signal 46 to activate the solid state relay 48 as long as the system is operating with adequate air pressure. Without adequate air pressure the electro-mechanical pressure switch 50 will electrically ground the solid state relay 48 and ensure the supply voltage 49 is not energized to the solid cartridge heater(s) 12.

A temperature sensor 51 is located to monitor the effective temperature of the dryer system, and to provide the external temperature measurement signal to the electronic controller 47. The temperature sensor 51 can monitor the temperature of the air distribution system's component; the air within the air distribution system; the air discharging from the air distribution system; a component that is in contact with the product being dried; etc. Depending on the location of the measurement point, the control response of the system and the maximum achievable temperature can vary greatly. To overcome this, the operational control gains of an electronic temperature controller can be adjusted to establish acceptable system controllability.

A circuit breaker 52 is incorporated as a switch and safety device for the control system of either the variable transformer control system or the electronic control system as shown in FIGS. 9 and 10 respectively.

The above text has described in detail the three basic subsystems of the forced air dryer including the air heating and distribution system, the air flow control system, and the electrical power control system. According to an exemplary embodiment of the invention, the three subsystems are combined into a singular compact unit for ease of integration with the web and into the narrow web press.

An advantage of this exemplary embodiment of the invention is that by housing all of the air flow and electrical controlling components of the dryer into a control box enclosure the components are isolated from the environment. These components include the electronic temperature controller, air flow regulator, pressure switch, solid state relay, and circuit breaker, all of which have already been described above.

Enclosing the air flow and electrical control components is an advantage of this embodiment since the control box enclosure can be gasket sealed and lightly pressurized to achieve a purged environment within the control box enclosure to prevent ingress of gases and contaminants. The lightly pressurized air is provided as a by-product of the relieving pressure regulator under normal operating conditions.

Enclosing the air flow and electrical control components is also an advantage of the invention in that all of the controlling components are substantially shielded from incidental debris generated by normal operation of the printing press. The debris includes ink spills, cleaning solvent, lubrication, etc.

It is also an advantage of the embodiments of the invention that the air flow lines and electrical lines to and from the control box enclosure can be connected and sealed such that the control box enclosure can be sealed and capable of being lightly pressurized.

It is an advantage of the embodiments of the invention that the operational controls are located such that they are accessible to operators of the narrow web press.

It is an advantage of the embodiments of the invention that the solid heater cartridge is enclosed within the air distribution system such as to result in acceptably low external surface temperatures of the air distribution system.

The air distribution system can be advantageously designed to accommodate the maximum web width of the printing press and to provide the desired residence time of the dryer. This is accomplished by appropriate layout of the manifold and air distribution system(s) within the dryer as described in detail earlier in the patent.

It is well known that drying capacity decreases as the distance between the web and the discharge orifices of the dryer increase. It is also well known that uniform drying will result when the web is held uniformly and at a constant distance from the dryer across both the length and width of the dryer, given that the discharging air flow and temperature are uniform across the same. It is an advantage of the embodiments of invention that the web can be held in the dryer at a close and even distance from the discharging air to achieve proper drying.

In consideration of retrofitting the dryer onto a narrow web press; the integration of the web support into the dryer will minimize press modifications and dryer design variations with respect to web handling as the web passes through the dryer. The web support that is incorporated into the dryer must provide an even support across both the width and the length of the dryer, such that the web is prevented from being deflected when subjected to the discharging air from the air distribution system(s). It is also an advantage of the embodiments of invention that the web support can be a simple device in that it provides the operator easy access for web threading and dryer cleaning It is an advantage of the embodiments of invention that all components and subsystems of the dryer can be housed into a single compact unit that can be mounted in an area where space is limited.

It is also an advantage of the embodiments of invention that the installation time of the dryer unit can be minimized. By including provisions into the dryer design, only mounting the dryer to the press and connecting to the electrical power and compressed air sources to the dryer can be required for installation.

The air flow regulator 42, pressure switch 50, electronic controller 47, solid state relay 48, and circuit breaker 52 can be housed in a dedicated control box enclosure 53. It is also an advantage of the embodiments of invention to include the control box enclosure 53, manifold 39, air distribution systems 13, and all interconnecting components inside the dryer enclosure 62.

Figure 12:
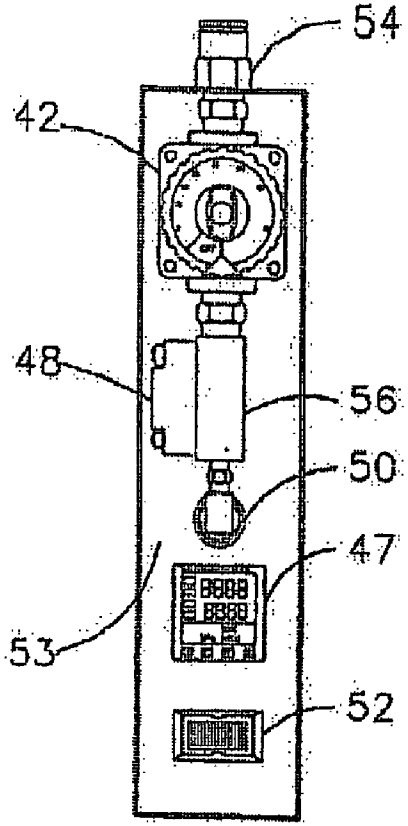
FIG. 12 is a front view of FIG. 11.
Figure 11:
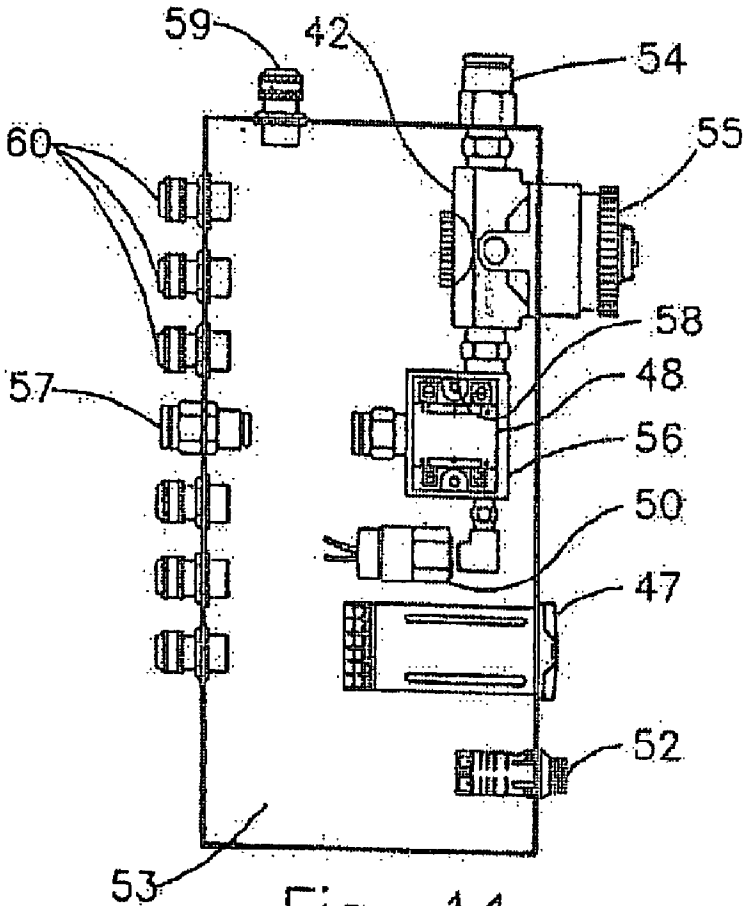
FIG. 11 is a side view of the assembled control box enclosure.

As illustrated in FIGS. 11 and 12, an external compressed air supply line is connected to the dryer through a single air supply port 54 on the control box enclosure 53. The air supply port 54 can be achieved by a number of means including a quick air disconnect, a push-to-connect fitting, a hose barb fitting, threaded pipe fitting, etc. An exemplary means is a push-to-connect fitting, which provides a convenient and tool-less means of connecting and disconnecting the dryer from the external pressurized air supply line.

The air supply port 54, which is rigidly joined to the air flow regulator 42, passes the supply air through the wall of the control box enclosure 53 and into the inlet port of the air flow regulator 42.

The air flow regulator 42 is advantageously accessible for manual adjustment by the press operator during normal operation of the dryer. The air flow regulator 42 can be mounted inside the control box enclosure 53 such that the control dial 55 of the air flow regulator 42 passes through an opening in the control box enclosure 53 thus allowing convenient manual adjustment of the air flow in the dryer.

According to the exemplary embodiment, air flow exiting the outlet port of the air flow regulator 42 passes through a specially designed air flow block 56 which is then connected to an air outlet port 57 mounted to the wall of the control box enclosure 53. The air flow block 56 can be connected to the air outlet port 57 by tubing. Outside of the control box enclosure, the air outlet port 57 can be connected to the inlet port on the manifold 39 by tubing.

The air flow block 56 can also provide an air pressure sensing port for the electro-mechanical pressure switch 50. The air flow block 56 can also provide holes 58 for mounting the solid state relay 48 firmly against the air flow block 56. This firm surface contact between the solid state relay 48 and the air flow block 56 can provide a means for heat generated by the solid state relay 48 to be transferred to air passing through the air flow block 56. The solid state relay 48 advantageously sheds this heat in order to operate safely and reliably, and the transfer of thermal energy to the air is an efficient use of the available thermal energy for the purpose of drying.

The electronic controller 47 is advantageously accessible for manual adjustment by the press operator during normal operation of the dryer. The electronic controller 47 can be mounted inside the control box enclosure 53 such that the temperature display and temperature controller keys are presented outside the control box enclosure 53 thus allowing convenient manual adjustment of the dryer temperature setting.

The circuit breaker 52 can operate as an electrical safety device and as a switch for energizing the control system of the dryer. The circuit breaker 52 can be mounted such that the switch can be manually switched from outside the dryer.

The electrical power supply to the dryer can be provided by an electrical cable that penetrates the wall of the control box enclosure 53 utilizing a sealed electrical bushing 59. The sealed electrical bushing 59 can have the capability to lightly pressurize the internal volume of the control box enclosure 53.

The electrical power supply can be connected to the circuit breaker 52 and then distributed internally to the electronic controller 47 and the solid state relay 48. The control signal from the electronic controller 47 can be connected through the pressure switch 50 and then to the solid state relay 48. The pressure switch 50 can be mounted to the pressure sensing port of the air flow block 56. When air flows through the air flow block 56, air pressure activates the pressure switch 50 and closes the electrical signal path between the electronic controller 47 and the solid state relay 48.

The electrical power can be switched on by the solid state relay 48 and then made available for connection to the solid cartridge heaters 12. The controlled electrical power output to each of the solid cartridge heaters 12 can be achieved by utilizing a sealed electrical bushing 60 for each of the solid cartridge heater power cables 61. The heater manufacturer can seal the power cables 61 to the end of the solid cartridge heaters 12 as part of the standard design.

The temperature sensor feedback signal cable can also pass through the control box enclosure wall utilizing a sealed electrical bushing (not shown). The temperature sensor feedback signal is signal-connected to the electronic controller 47.

Figure 13:
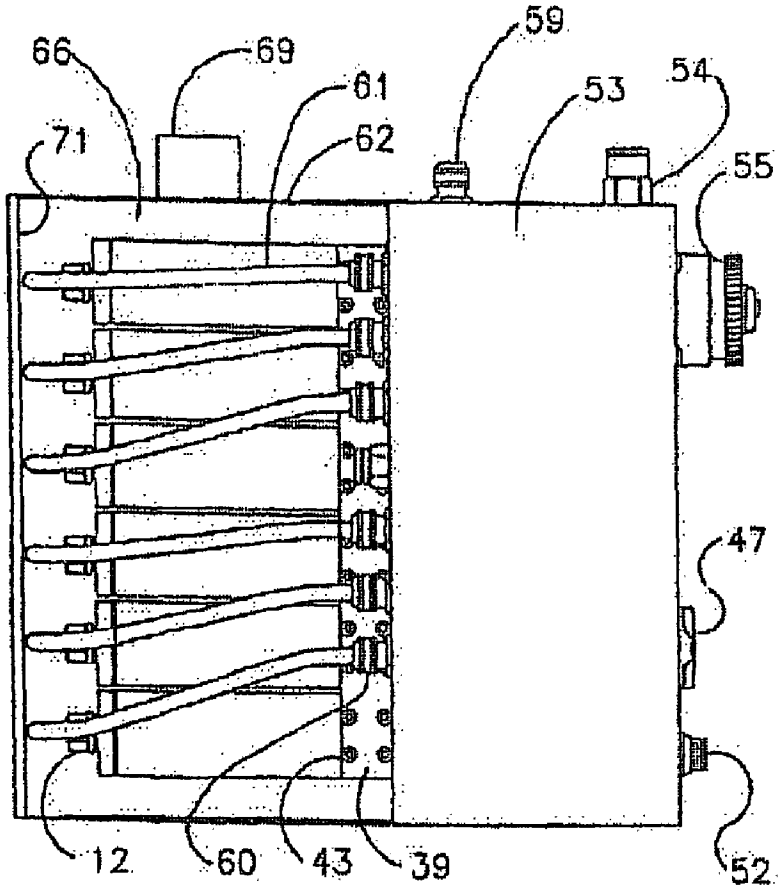
FIG. 13 is a side view of the assembled dryer.
Figure 14:
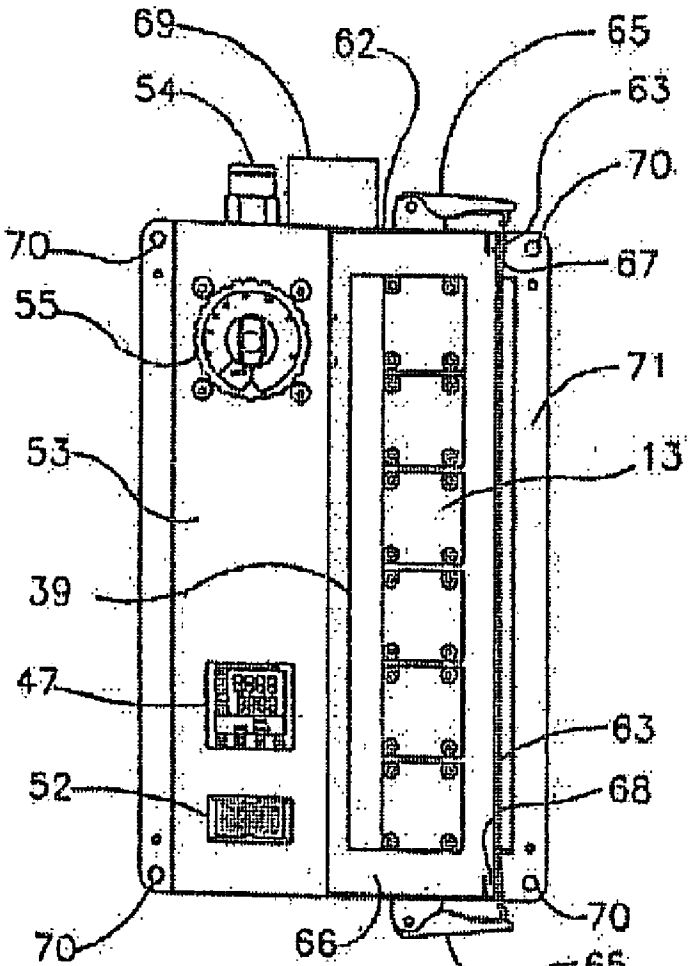
FIG. 14 is a front view of FIG. 13.

As illustrated in FIGS. 13 and 14, the control box enclosure 53 can be mounted to the dryer enclosure 62. The manifold 39 and air distribution system(s) assembly can be mounted to the dryer enclosure 62.

Figure 15:
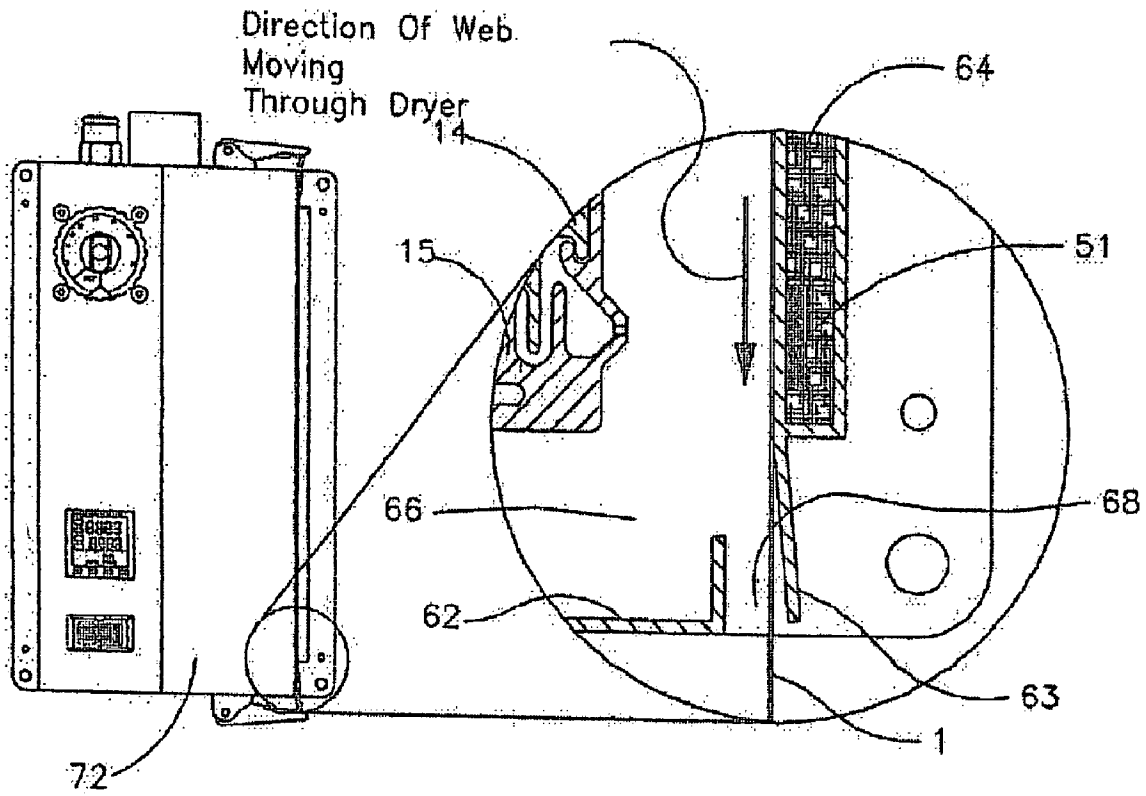
FIG. 15 is a sectional view of the temperature monitoring means for the dryer.

As shown in FIG. 15, the web can be supported by a slide plate 63. The slide plate 63 can be of a sheet metal construction, and can be attached to back side of the dryer enclosure 62 by use of a hinge allowing the slide plate 63 to function as a door. Mechanical latches 65 can be located towards the frontside of the dryer enclosure providing a convenient means for the press operator to open the slide plate for manual threading of the web through the dryer during machine set up, or for maintenance access to clean the air distribution systems 13. The slide plate 63, hinge, latches 65 and supporting structure of the enclosure can be designed to ensure that when closed, the slide plate 63 provides a firm web support that is positioned approximately ½" from the discharge orifices of the air distribution system. The mechanisms described above also ensure that the location of the slide plate 63 relative to the air distribution systems 13 is held evenly across the length and width of the dryer.

Normal operation of the dryer discharges significant volumes of air into the area where the product is being dried. As the product dries, significant volumes of solvent vapor are evaporated into the area where the product is being dried. It is an advantageous that the mixture of discharged air and evaporated solvent vapors are removed. This is achieved by substantially enclosing the area where the product is being dried within a box 66 and then exhausting the internal volume of the box 66.

The dryer enclosure 62 and control box enclosure 53 form five of the six sides of the box type construction of the box 66. The slide plate 63 and web provide the sixth side of the box 66. It is advantageous that minimal slot openings 67 and 68 are provided for the web to enter and exit the box 66 respectively. An external exhaust system provides the light suction necessary to draw the air and solvent vapors from inside the box 66, and is connected to an exhaust port 69 located on the dryer enclosure to remove air and solvent vapors from inside the box 66.

Mounting holes 70 for attaching the dryer to the narrow web press structure are provided in the back plate 71 of the dryer enclosure 62 of the dryer.

As briefly discussed earlier in the patent, dryer systems monitor and control a temperature of an element of the dryer system. It is most desirable to measure the actual product temperature of the product being dried since the product temperature is indicative of the level of drying that has been achieved. Historically, the means of measuring the actual product temperature has been very difficult to implement.

In lieu of measuring the temperature of the product being dried, a common practice has been to measure the temperature of the forced air of the dryer with the general assumption that the product achieves the substantially equivalent temperature of the forced air. Depending on the product, process, and application this assumption may be invalid.

It is one aspect of the invention that a means is provided that will more accurately represent the actual temperature of the product being dried. FIG. 15 illustrates this embodiment.

A commercially available temperature sensor 51 can be mounted onto the backside of the metallic slide plate 63, near the end of the metallic slide plate 63 where the web 1 exits the dryer 72. The temperature of the metallic slide plate 63 in this area will essentially stabilize at the temperature of the web due to the close and constant proximity with the heated web 1.

Additional heat loads in the slide plate 63 may be generated due to the friction of the web 1 sliding over the slide plate 63. The additional heat loads from friction are considered negligible due to the low contact force of the web 1 against the slide plate 63. To minimize any other interference from the environment to the temperature sensor 51, insulation 64 is added onto the backside of the slide plate 63 and the temperature sensor 51. The thermocouple wire leads are then routed back to the input of the dryer's temperature controller.

Alternately to this embodiment, the temperature sensor 51 can be located within one of the recesses 31 of one or more of the plenums 15, mounted to the plenum 15 as shown in FIG. 3. Insulation (not shown) can be added onto the backside of the temperature sensor 51 onto the plenum 15 to minimize any other interference from the environment.

Figure 16:
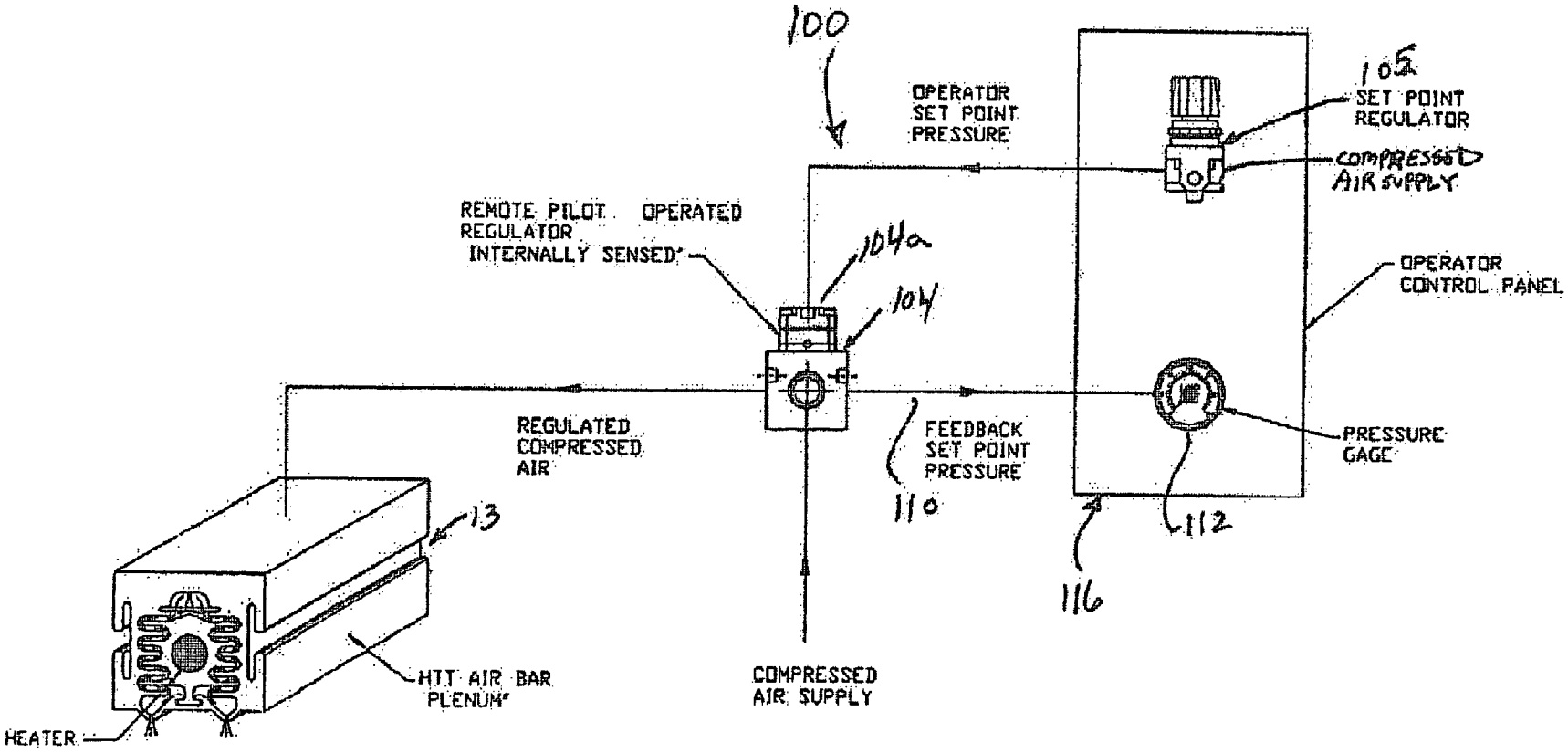
FIG. 16 is a schematic illustration of an alternate air flow control system for the dryer.

FIG. 16 illustrates an alternate embodiment of an air flow control system. In this system 100, a remote pilot-operated regulator or dome loaded regulator 104 is used to control air flow into the unit or units 13. A conventional set point regulator 105 is operator controlled to send pilot pressure or set point pressure air to the dome 104*a* of the dome loaded regulator. The regulator 104 sends regulated compressed air to the unit or units 13 that is controlled by the regulator 104 to be equivalent to the operator set point pressure. The regulator is internally sensed, that is, the feedback of the output pressurized air of the regulator is taken from a tap within the regulator, just downstream of the regulator valve element. A feedback line 110 sends the regulated compressed air to a pressure gauge 112 located near the set point regulator 105. The set point regulator 105 and pressure gauge can be located in a control box 116. Alternately, all the components shown in FIG. 16 can be located in a common enclosure for the reasons described herein.

The foregoing illustrative dryer systems can include the following features:

1. All components and subsystems of the dryer can be combined into a single unit that can be mounted in an area where space is limited.

2. Provisions have been made to minimize the installation time of the dryer unit so that only mounting the dryer to the press and connecting the dryer to the electrical power and compressed air sources will be required for installation.

3. An air distribution system maintains cool external surface temperatures while simultaneously integrating the heat source directly into the air distribution system at the immediate vicinity of the discharging forced air.

4. A control system for both air flow and air temperature is integrated directly with the dryer system so as to provide a convenient means for the operator to make adjustments to either the air flow setting or temperature setting or both at the dryer location. The integration of the control system into the dryer eliminates the need for the operator to make said adjustment(s) from an inconvenient remote location.

5. The heat source is mounted within the air distribution plenum providing the most efficient means of utilizing the power from the heat source for the purpose of drying. The air is heated just before it is dispersed through the air release orifices onto the web. By combining the heat plant into the air distribution plenum, the unit is very compact, requires fewer parts, and is less expensive to manufacture.

6. When the dryer system is operated in a gaseous environment, the control box enclosure can be gasket sealed and lightly pressurized to achieve a purged environment within the control box enclosure. The lightly pressurized air is provided as a by-product of the relieving pressure regulator under normal operating conditions.

7. A slide plate is used to provide even support to the web as the web passes through the dryer. The slide plate has a hinge and latch configuration that allows the press operator a convenient means to rock the slide plate back out of the way for manual threading of the web through the dryer during machine set up, or for maintenance access to clean the air distribution assemblies.

8. Solid cartridge heaters are available with various power levels in the same cylindrical geometry. A conveniently located bulkhead plate with a threaded port is used to mount the solid cartridge heater in the air distribution system. This provides the press operator with a means to readily change out solid cartridge heaters with different power levels for different processes and application.

9. The effective drying temperature of the dryer is measured using a temperature sensor that is mounted to a metallic slide plate that is in contact with the web. The temperature of the metallic slide plate essentially stabilizes at the temperature of the web, due to the contact with the web, and will provide the operator with a more accurate measurement of the effective drying temperature of the process. This can greatly reduce set up time and maintain quality on repeat jobs.

10. Solid cartridge heaters are available with variable power densities along the axial length of the solid cartridge heater. The variable power densities can be used to create hot or cold spots in specific intervals or in specific areas along the width of the dryer to counteract uneven flow patterns past the solid cartridge heater or to meet specific process or application requirements.

Figure 17:
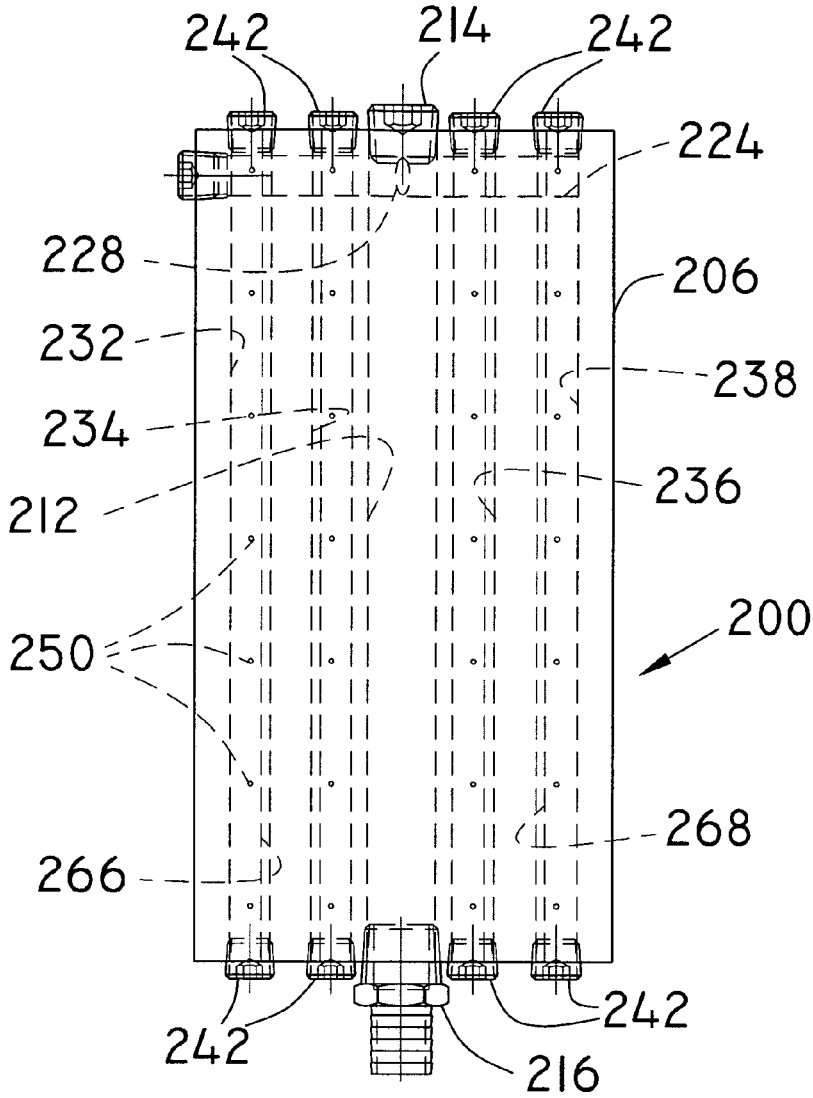
FIG. 17 is a top plan view of an alternate embodiment air distribution system.

FIG. 17 illustrates an alternate embodiment air distribution system 200 to the previously described system 13. The system can be used as a replacement for the system 13 in the previously described control schemes, multiple system schemes and housing schemes.

According to this embodiment, a substantially solid body 206 includes a main longitudinal air channel 212 that is closed with a plug 214 at one end, and in air communication with an air inlet nozzle 216 and an opposite end. Preferably, the channel 212 is a cylindrical bore through the body 206. A secondary lateral air channel 224 intersects the main air channel 212 forming a port 228 between the channels 212, 224. The channel 224 is preferably a bore that laterally proceeds through the block 206 to intersect the channel 212 and to intersect four distribution channels 232, 234, 236, 238. The channels 232-238 are longitudinally arranged through the block 206. The channels preferably are plugged on opposite ends with plugs 242.

Each channel 232-238 is in air flow communication with a plurality of air distribution orifices 250 through the block wall, spaced apart along a length of the channels 232-238. Accordingly, pressurized air that is input into the air inlet nozzle 216 passes through the main channel 212, passes through the secondary channel 224, and passes into the four distribution channels 232-238. Air within the distribution channels 232-238 is distributed substantially equally through the orifices 250 and impinges upon an object to be dried.

Figure 18:
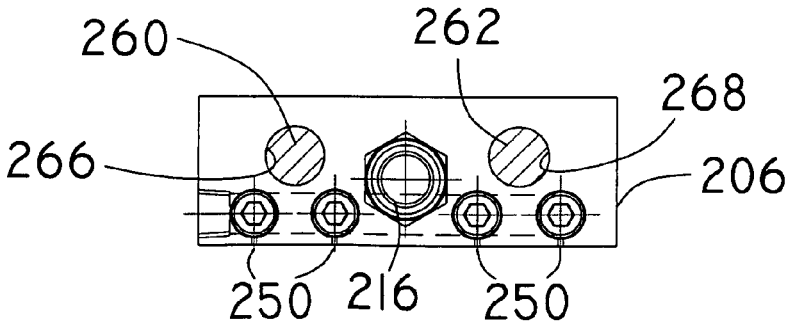
FIG. 18 is an end view of the alternate embodiment of FIG. 17.

As shown in FIG. 18, at least one, and preferably two cartridge heater elements 260, 262 are fit tightly into channels 266, 268, respectively. The cartridge heaters transfer heat by conduction into the block 206 by being in close heat transfer contact with the block 206 within the bores 266, 268. The cartridge heaters can be of the type heretofore described.

In operation, as the air passes through the channels 212, 224, 232-238 it is heated primarily by convection and conduction, by being in heat transfer contact with the block 206, which is heated by the cartridge heaters 260, 262.

The embodiment of FIGS. 17 and 18 provides a simplified, easily and cost-effectively constructed air heating and distribution system 200 that is adequate for many drying applications. The rectangular block 206 is preferably composed of aluminum and can be ganged or clustered with like blocks 206 to form a bank of systems 200 for larger drying applications. Alternatively, a single block 206 can be used for smaller drying applications such as using the system 200 as a finger nail polish drying apparatus in a salon.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A forced hot air drying unit, comprising:

an elongated body with an air inlet and an internal air cavity, said air inlet open into said internal air cavity to allow pressurized air to enter said internal air cavity, at least one air outlet arranged along a length of said internal air cavity to allow air to pass from said internal air cavity to the exterior of said body, and a heater element mounted in heat transfer contact with said body; wherein said internal air cavity comprises at least one longitudinal air channel and a lateral air channel, said at least one longitudinal air channel in flow communication with said air inlet at one end and with said lateral channel at an opposite end, said lateral channel in flow communication with said air outlet; and wherein said body comprises a rectangular block and said at least one longitudinal channel comprises a main longitudinal channel and at least one distribution longitudinal channel substantially through said block, said main longitudinal channel and said at least one distribution longitudinal channel having said at least one air outlet which comprises a plurality of spaced-apart air outlets, and wherein said block comprises a longitudinal heater channel for closely receiving said heater element, said air channel and said heater channel being separated by solid portions of said block.

2. The forced hot air drying unit according to claim 1, wherein said heater element is configured to have variable power density to provide a substantially constant air temperature of air exiting said at least one air outlet.

3. The forced hot air drying unit according to claim 1, wherein said elongated body comprises a unitary piece that provides said air cavity and said heater cavity.

4. The forced hot air drying unit according to claim 1, comprising:

a plurality of combinations, each combination including one said elongated body and one said heater element, said body receiving said heater element, that each receive, heat, and disperse said pressurized air, a means for controlling the flow of said pressurized air passing through said plurality of combinations; and a means for controlling the temperature of the air passing through said plurality of combinations.

5. The forced hot air drying unit according to claim 4, comprising:

an enclosure;

at least one control for influencing the amount of forced air drying; and wherein said plurality of combinations and said control are contained within said enclosure.

6. The forced hot air drying unit according to claim 5, wherein said control comprises a heater control for controlling air temperature.

7. The forced hot air drying unit according to claim 5, wherein said control comprises an air pressure regulator connected to a source of pressurized air and to said air inlet.

8. The forced hot air drying unit according to claim 5, comprising an air distribution path including a manifold located within said enclosure that is air flow connected to all air inlets of said elongated bodies, and a common air inlet open to said manifold and connectable to a source of pressurized air on an outside of said enclosure.

9. The forced hot air drying unit according to claim 8, wherein said heater elements comprise electrical heaters and comprising a common connector, wherein each heater element within each said elongated body has an electrical connection that is connected to said common connector, said common connector being connectable to a source of electrical power on an outside of said enclosure.

10. The forced hot air drying unit according to claim 1, wherein said heater element comprises a solid cartridge heater.

11. The forced hot air drying unit according to claim 1, wherein said air inlet comprises a port protruding from an end wall of said block.

12. The forced hot air drying unit according to claim 1, wherein said heater cavity is defined by cylindrical side wall of said body and said heater element comprises a cylindrical outer surface that fits in continuous contact with said side wall.

13. The forced hot air drying unit according to claim 1, wherein said heater element comprises a solid cartridge heater, and said heater element is configured to have variable power density to provide a substantially constant air temperature of air exiting said at least one air outlet.

* * * * *